US006142805A

United States Patent [19]

Gray et al.

[11] Patent Number: 6,142,805

[45] Date of Patent: Nov. 7, 2000

[54] WATERPROOF GEOPHYSICAL CONNECTOR

[75] Inventors: Larry M. Gray, Katy; Andrew Au, Cypress, both of Tex.

[73] Assignee: Geo Space Corporation, Houston, Tex.

[21] Appl. No.: 09/390,075

[22] Filed: Sep. 3, 1999

[51] Int. Cl.[7] ..... H01R 4/60

[52] U.S. Cl. ..... 439/206; 272/276; 272/135; 272/587

[58] Field of Search ..... 439/206, 272, 439/276, 135, 604, 736, 936, 281, 282, 271, 588, 587, 589

[56] References Cited

U.S. PATENT DOCUMENTS

| | | | |
|---|---|---|---|
| 1,978,510 | 10/1934 | Spence, Jr. | 439/145 |
| 2,350,367 | 6/1944 | Peters et al. | 439/206 |
| 2,962,688 | 11/1960 | Werner | 439/135 |
| 3,550,064 | 12/1970 | Caller et al. | 439/276 |
| 3,622,940 | 11/1971 | Illies | 439/272 |
| 3,633,150 | 1/1972 | Swartz | 439/135 |
| 3,657,681 | 4/1972 | Falkner | 439/205 |
| 3,953,099 | 4/1976 | Wilson | 439/281 |
| 4,053,201 | 10/1977 | Grappe | 439/604 |
| 4,266,844 | 5/1981 | Chelminski | 439/736 |
| 4,335,932 | 6/1982 | Herrmann, Jr. | 439/936 |
| 4,553,807 | 11/1985 | Cane | 439/206 |
| 4,606,603 | 8/1986 | Cairns | 439/206 |
| 4,854,886 | 8/1989 | Neuroth | 439/276 |
| 4,907,980 | 3/1990 | Wagaman et al. | 439/206 |
| 5,007,852 | 4/1991 | Dean et al. | 439/205 |
| 5,083,940 | 1/1992 | Larson et al. | 439/276 |
| 5,215,475 | 6/1993 | Stevens | 439/206 |
| 5,387,119 | 2/1995 | Wood | 439/589 |
| 5,518,415 | 5/1996 | Sano | 439/936 |
| 5,542,856 | 8/1996 | Wood | 439/587 |
| 5,567,170 | 10/1996 | Kroeber | 439/272 |
| 5,704,799 | 1/1998 | Wood | 439/587 |
| 5,733,145 | 3/1998 | Wood | 439/604 |
| 5,800,195 | 9/1998 | Endo et al. | 439/271 |
| 5,934,911 | 8/1999 | Stout et al. | 439/271 |
| 5,980,317 | 11/1999 | McNeel | 439/589 |
| 6,017,227 | 1/2000 | Cairns et al. | 439/271 |

*Primary Examiner*—Paula Bradley
*Assistant Examiner*—Katrina Davis
*Attorney, Agent, or Firm*—Fulbright & Jaworski

[57] ABSTRACT

A waterproof geophysical connector including a rigid plastic body supporting a hard plastic insert which in turn supports a plurality of electrical contacts. A compression nut is connected to the body and an electrical cable extends through the compression nut to the inside of the body and is connected to the electrical contacts. A plastic potting compound fills the body and a plastic overmold is applied between the cable and the body and a fluid clearance space is provided between a rotatable coupling ring and the outside of the body for clearing debris.

5 Claims, 3 Drawing Sheets

WATERPROOF GEOPHYSICAL CONNECTOR

FIELD OF THE INVENTION

A waterproof geophysical connection for use in transition zone marine environments including a hard plastic outer body surrounded by a rotatable external coupling ring with slots in the coupling ring and clearances between the ring and body for flushing out debris for allowing the ring to be easily rotatable.

The body contains a core of potting compound which is poured in liquid form into the body to secure the cable terminus and provide shock resistance and waterproofing. The wires of the cable are secured and connected in a waterproof fashion to electrical contacts connected to a hard plastic insert which is connected to the body for stability and longitudinal strength.

BACKGROUND OF THE INVENTION

Geophysical connectors used in the geophysical field environment are subject to water and thus are required to be waterproof. One common problem is that the electrical cable to the connector may sustain a cut in the outer jacket allowing water to enter within the central cavity of the cable allowing water to migrate internally down the electrical wires and enter the center cavity of the connector body. Other waterproofing problems occur due to leakage between components of the connector or around the electrical contacts of the connector. In any event, if water communicates from one electrical contact to another electrical contact electrical leakage, or a short circuit condition, will occur.

Another problem that occurs in geophysical connections is that an external coupling ring containing threads must be rotated relative to the body to connect the connector to the object to which the geophysical connector is attached. However, in spite of commonly used seals between the body and the coupling ring debris will accumulate therebetween binding the coupling ring to the body and making rotation therebetween difficult.

SUMMARY OF THE INVENTION

The present invention provides a geophysical connector comprising an internal core of polyurethane that encapsulates the terminus of an electrical cable within a flexible and resilient environment while connecting it to conducting electrical contacts in a hard plastic insert placed in longitudinal series with the internal core. The terminal end of the cable is secured by a strength member to the connector. The connection point of the cable wires to electrical pins 15 protected by O-rings and a heat activated shrink tubing. The core is contained within a hard plastic body that allows permanent attachment of the cable terminus and the plastic insert. The cable end of the connector is covered with a polyurethane overmold, while the connector insertion end is contained within a coupling ring of hard plastic with a clearance space present between the ring and the body.

A still further object of the present invention is the provision of a waterproof geophysical connector having a hard rigid tubular plastic body having first and second ends and having an inside and an outside. A hard plastic tubular insert is threadably connected to the inside of the first end of the body and includes first and second ends and an inside and an outside. A plurality of electrical contacts are secured to the inside of the tubular insert and a soft plastic seal is positioned in the first end of the tubular inset for scaling against a mating connection of the geophysical connector. A compression nut is threadably connected to the inside of the second end of the body and an electrical cable extends through the compression nut to the inside of the body and is connected to the electrical contacts. A plastic potting compound fills the inside of the body and encapsulates the electrical connection of the cable to the electrical contact, and a plastic overmold is applied to the outside of the second end of the body, the compression nut, and the cable.

A tubular coupling ring is rotatably mounted about the outside of the body and includes coupling threads, a lip engaging a lip on the outside of the hard plastic insert and the coupling ring includes a plurality of slots therethrough for passage of fluids. The outside of the body includes a depression adjacent the slots providing a clearance space for allowing circulation of cleaning fluid between the outside of the body and the coupling ring for cleaning out debris therebetween.

Still a further object of the present invention is the provision of a soft sealing ring included in a dust cap and adapted to coact with the sealing ring and the plastic insert.

Yet a further object of the present invention is the provision of one or more O-rings in the inside of the body around each wire of the electrical cable and shrink tubing over the O-rings and the connection of the cable to the electrical contacts for increasing the waterproofing.

Yet a still further object is wherein the hard plastic insert includes a sealing boss around the ends of the electrical contacts and are in turn surrounded by the shrink tubing.

Other and further objects, features and advantages will be apparent from the following description of a presently preferred embodiment of the invention, given for the purpose of disclosure, and taken in conjunction with the accompanying drawings.

DETAILED DESCRIPTION OF THE PREFERRED EMBODIMENT

Figure 1:
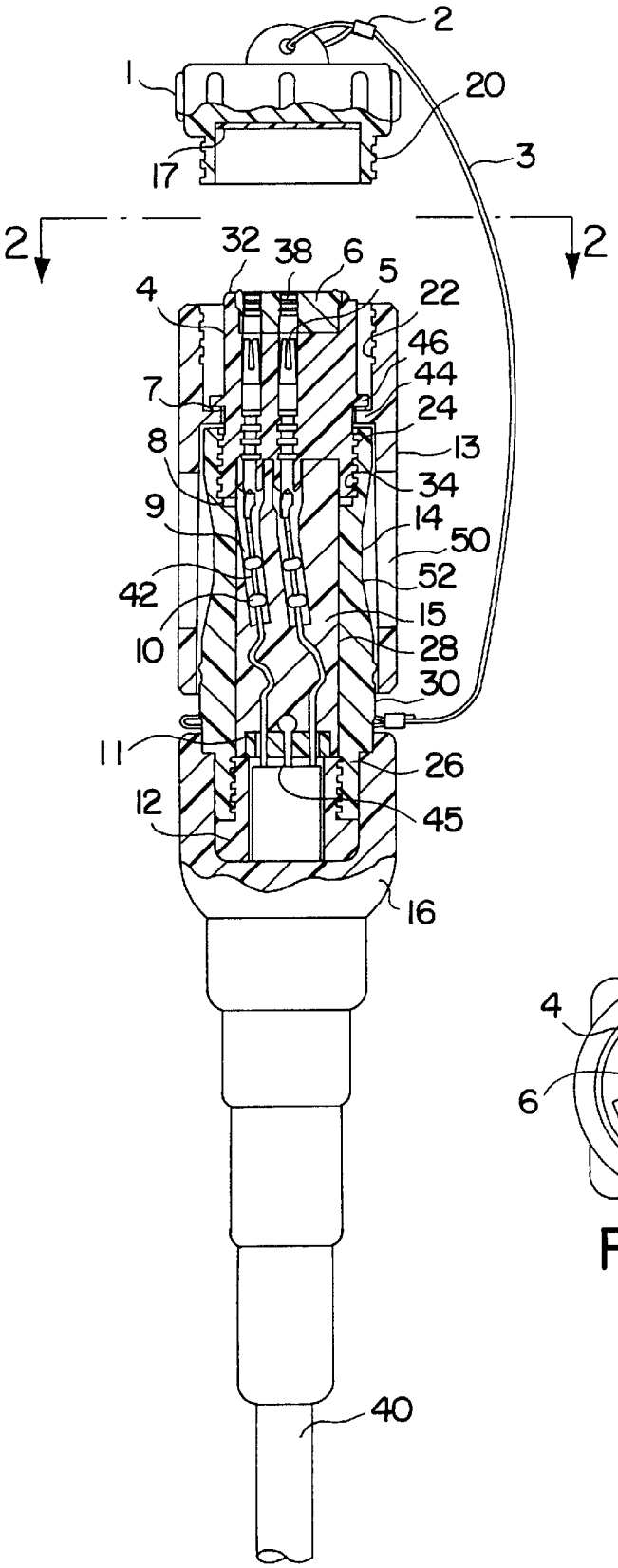
FIG. 1 is an elevational view, partly in cross section, of the geophysical connector of the present invention showing a dust cap disconnected from the connector.
Figure 2:
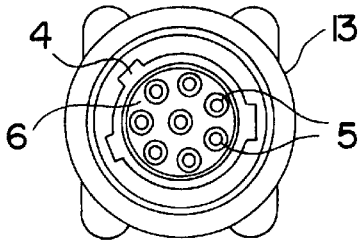
FIG. 2 is a cross-sectional view taken along the line 2—2 of FIG. 1.
Figure 3:
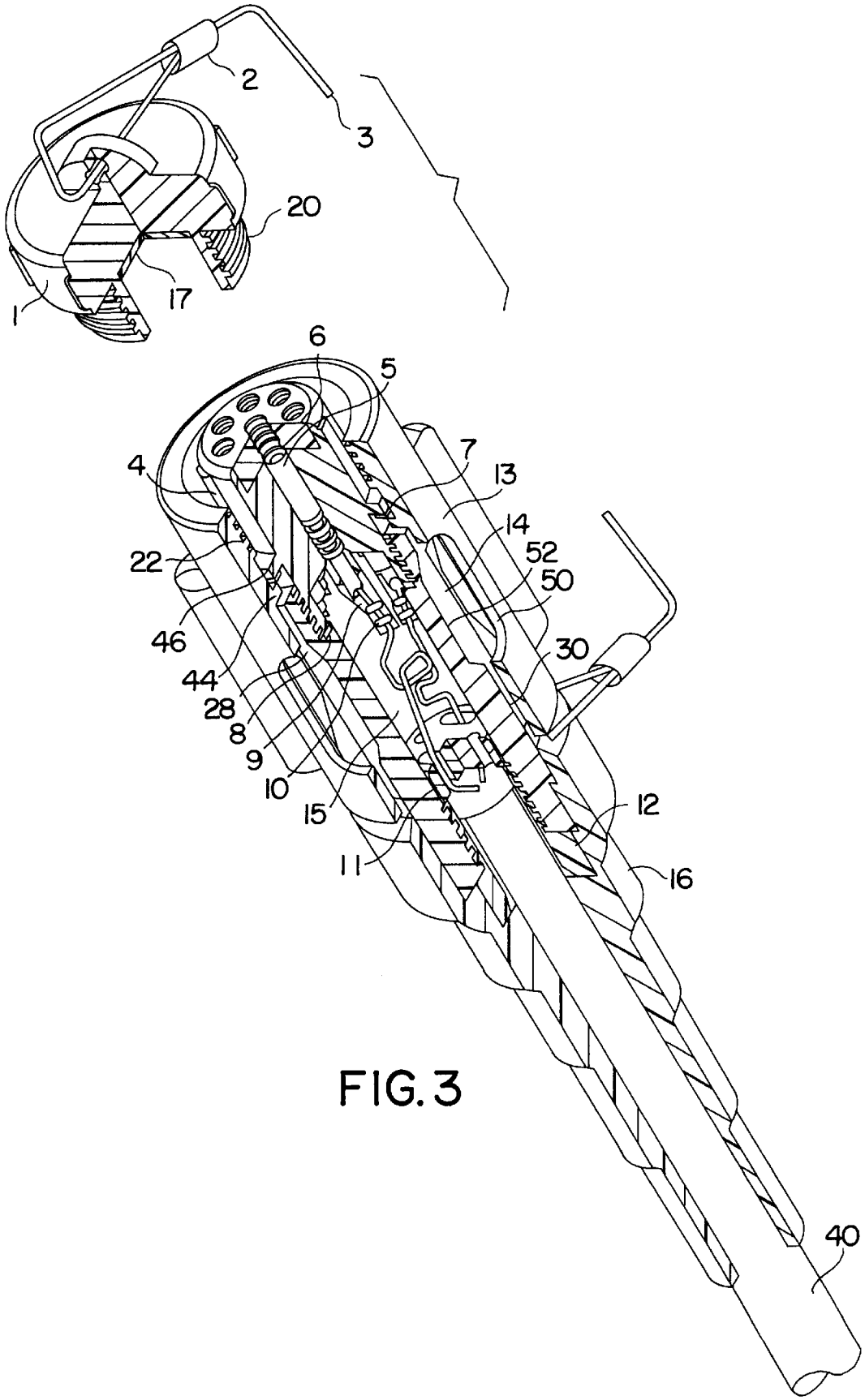
FIG. 3 is a view similar to FIG. 1 shown in a perspective view.
Figure 4:
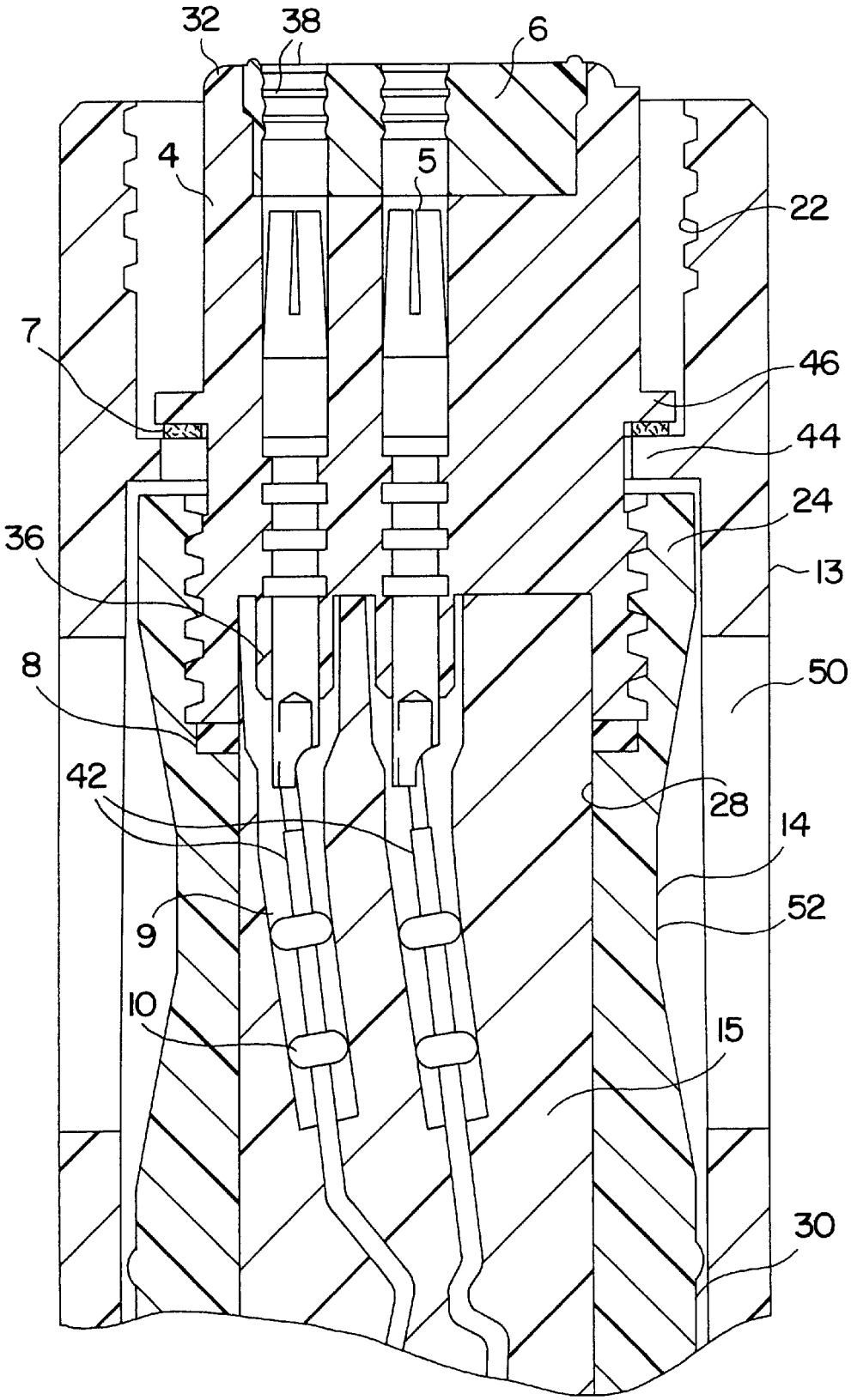
FIG. 4 is a cross-sectional enlarged view of the top of the connector.

A dust cap 1 of glass reinforced polyurethane such as BF Goodrich ESTALOC® is threaded at 20 to be connected to threads 22 of a coupling ring 13 of a glass reinforced nylon such as DuPont ZYTEL®. The dust cap 1 has a cable 3 of either plastic coated stainless steel or nylon rope attached to it which loops loosely around the connector body 14, so as to permanently connect the dust cap to the terminal end of the cable connector assembly. The cable 3 of either material, is secured at the ends by either a shrink-lock device, or a crimping sleeve 2.

The connector body 14 is a hard rigid tubular plastic body such as glass reinforced polyurethane such as BF Goodrich ESTALOC® having a first end 24 and a second end 26 and having an inside 28 and an outside 30. A hard plastic tubular insert 4 has a first end 32 and a second end 34 and the second end 34 is threadably connected to the inside of the first end 24 of the body 14. In addition, the insert 4 includes an inside and an outside.

A plurality of electrical contacts, either pins or sockets here shown as sockets 5 are secured to the inside of the tubular insert 4 and longitudinally through the insert 4. The second ends of the insert 4 include raised sealing bosses 36 surrounding the internal termini of the electrical contact sockets 5. In addition, a soft plastic seal 6 with O-rings 38 is molded in the first end of the tubular insert 4 for surrounding the other ends of the electrical contacts 5 and sealing against a mating connecting of the geophysical connector. The soft scaling ring 6 may be of polyurethane of 70 durometer. The second end of the insert 4 is sealed from the opposing internal surface of the body 14 by a quad ring 8 of BUNA N rubber of 70 durometer, size Q4-117.

A compression nut 12 is threadably connected to the inside of the second end 26 of the body 14. Therefore, the threaded connections at the first end 24 and the second end 26 of the body 14 provide the structure for supporting the connector. The compression nut 12 may be of glass reinforced polyurethane. The mating threaded surfaces between the body 14 and the compression nut 12, and the insert 4 are coated with a thread locking compound such as LOCTITE® when they are mated.

An electrical cable 40 to be connected passes through an opening in the longitudinal axis of the compression nut 12 and includes a plurality of wires 42. The cable 40 has an aramid fiber strength member 45 such as DuPont KEVLAR® running in longitudinal fashion through its length. The terminus of the aramid strength fiber member 44 is permanently attached to a stress ring 11 of glass reinforced nylon which abuts the internal surface of the compression nut 12.

The internal electrical wires 42 of the cable 40 pass longitudinally through the compression nut 12 and the stress ring 11 into the inside of the body 14. The electrical wires 42 of the cable 40 are connected to the electrical contacts 5 in the insert 40. One or more sealing O-rings 10 such as of VITON® are placed sequentially on each terminal end of the cable wires 42. A heat actuated shrink tubing 9 with internal adhesive is applied around the sealing bosses 36, the terminal ends of the cable wires 42 and their connection to the contacts 5 and over the O-rings 10. The entire inner space in the inside of the body 14 is filled with a potting compound 15 of polyurethane which is fluid on insertion, but which hardens over time to be solid and resilient but shock absorbing and waterproof A plastic overmold 16 such as BF Goodrich ESTANE® is applied over the terminal end of the cable 40 and for some length along the length of the cable 40 covering the compression nut 12 and its seam between the cable 40 and the compression nut 12 and covering the scam between the compression nut 12 and the second end 30 of the body 14.

The tubular coupling ring 13 is rotatably mounted about the outside 30 of the body 14. The ring 13 includes the coupling threads 22 and a lip 44 engaging a lip 46 on the outside of the hard plastic insert 4. Thus, when the ring 13 is threaded by the threads 22 to an object to be connected the insert 4 and electrical contacts 5 are carried into engagement. At the interface between the lip 44 of the coupling 13, and the lip 46 of the insert 4, is an anti-friction washer 7 such as of glass reinforced nylon.

The rotatable coupling ring 13 has one or more slots 50 preferably longitudinally extending in its surface to allow the passage of fluid to the outside 30 of the body 14. In addition, the outside 30 of the body 14 includes a depression 52 around the circumferential axis to allow greater circulation of fluid between the body 12 and the coupling ring 13 both to reduce the possibility of fouling or sticking a coupling between the body 14 and to increase the efficiency of clearing a fouled coupling 13 if it does occur. Thus, the depression 52 provides a space for circulation of cleaning fluid between the outside of the body 14 and the inside of the coupling ring 13 for cleaning out debris therebetween.

The present invention, therefore, is well adapted to carry out the objects and attain the ends and advantages mentioned as well as others inherent therein. While a presently preferred embodiment of the invention has been given for the purpose of disclosure, numerous changes in the details of construction, and arrangement of parts will be readily apparent to those skilled in the art and which are encompassed within the spirit of the invention and the scope of the appended claims.

What is claimed is:

1. A waterproof geophysical connector comprising:

a hard rigid tubular plastic body having first and second ends, and having an inside and an outside, a hard plastic insert releasably connected to the first end of the body, a plurality of electrical contacts secured to the hard plastic insert, a compression nut releasably connected to the second end of the body, an electrical cable extending through the compression nut to the inside of the body and connected to the electrical contacts, a plastic potting compound filling the inside of the body and encapsulating the electrical connection of the cable to the electrical contacts, a plastic overmold applied to the outside of the second end of the body, the compression nut and the cable, a coupling ring rotatably mounted on the outside of the body, said ring including a lip engaging a lip on the hard plastic insert, said coupling ring including one or more slots therethrough for the passage of fluids, and the outside of the body including a depression adjacent said slots for allowing circulation of fluid between the body and the coupling ring for cleaning out debris.

2. The apparatus of claim I including a soft seal ring about the electrical contacts and in the plastic insert, and a dust cap releasably connected to the coupling ring and including a soft seal adapted to coact with the seal ring.

3. The apparatus of claim 1 including, one or more O-rings in the inside of the body around each wire of the electrical cable and shrink tubing over the O-rings and the connection of the cable to the electrical contacts.

4. The apparatus of claim 3 wherein the hard plastic insert includes a scaling boss around the ends of the electrical contacts and are in turn surrounded by the shrink tubing.

5. A waterproof geophysical connector comprising:

a hard rigid tubular plastic body having first and second ends, and having an inside and an outside, a hard plastic tubing insert threadably connected to the inside of the first end of the body, and having first and second ends and an inside and an outside, a plurality of electrical contacts secured to the inside of the tubular insert, a soft plastic seal positioned in the first end of the tubular insert for sealing against a mating connection of the geophysical connector, a compression nut threadably connected to the inside of the second end of the body, an electrical cable extending through the compression nut to the inside of the body and connected to the electrical contacts, a plastic potting compound filling the inside of the body and encapsulating the electrical connection of the cable to the electrical contacts, a plastic overmold applied to the outside of the second end of the body, the compression nut and the cable, a tubular coupling ring rotatably mounted about the outside of the body, said ring including coupling threads and a lip engaging a lip on the outside of the hard plastic insert, said coupling ring including a plurality of slots therethrough for the passage of fluids, and the outside of the body including a depression adjacent said slots providing a space for allowing circulation of cleaning fluid between the outside of the body and the coupling ring for cleaning out debris therebetween.

* * * * *